US007132139B2

(12) United States Patent
Yang

(10) Patent No.: US 7,132,139 B2
(45) Date of Patent: Nov. 7, 2006

(54) STRUCTURE OF AN ASSEMBLED TYPE CHRISTMAS TREE

(75) Inventor: Chen-Sheng Yang, Kaohsiung (TW)

(73) Assignee: Chao Tai Electron Co., Ltd., Kaohsiung (TW)

( * ) Notice: Subject to any disclaimer, the term of this patent is extended or adjusted under 35 U.S.C. 154(b) by 93 days.

(21) Appl. No.: 10/950,545

(22) Filed: Sep. 28, 2004

(65) Prior Publication Data

US 2006/0068129 A1 Mar. 30, 2006

(51) Int. Cl.
*A01N 3/00* (2006.01)

(52) U.S. Cl. ..... 428/17

(58) Field of Classification Search ..... 428/7, 428/12, 18, 19, 20, 27; 211/37, 34
See application file for complete search history.

*Primary Examiner*—Jennifer C. McNeil
*Assistant Examiner*—Gordon R. Baldwin
(74) *Attorney, Agent, or Firm*—Rosenberg, Klein & Lee

(57) ABSTRACT

A Christmas tree includes a trunk, and several lamp sets; the trunk includes several hollow rods, which are separably connected together by inserting lower ends into upper ends of adjacent rods, and each of which has a hole; each hollow rod has a first and a second connecting members respectively securely fitted in the upper and the lower ends thereof; each first connecting member having a fitting hole, and two terminals; each second connecting member has two terminals facing outwards; each hollow rod has cords therein, which are connected to the terminals in two ends thereof; the lamp sets are passed through the holes of the rods from cord parts thereof, which are connected to corresponding terminals in the rods; all of the lamp sets will be electrically connected to the cords in the rods after the rods are connected together for the terminals to be electrically connected.

1 Claim, 6 Drawing Sheets

STRUCTURE OF AN ASSEMBLED TYPE CHRISTMAS TREE

BACKGROUND OF THE INVENTION

1. Field of the Invention

The present invention relates to a Christmas tree, more particularly one, which is structured in such a way that it is easy to assemble and dismantle, and that the joints between the cords of the lamp sets and the trunk thereof are hidden inside the trunk, prevented from showing to spoil the appearance of the Christmas tree or cause danger.

2. Brief Description of the Prior Art

Christmas trees are common decorations in Christmas. Christmas trees usually have other small decorative objects and lamp sets hung thereon to be attractive. And, assembled type Christmas trees are available whose trunks can be dismantled into several parts when they are not used.

Assembled type Christmas trees are popular because they can be dismantled to occupy less space for easy storage. However, conventionally lamp sets are fitted on an assembled type Christmas tree by means of connecting plugs to cord parts of the lamp sets and connecting the plugs to exposed portions of power cords, which are supported on the assembled trunk member of the Christmas tree. Consequently, the joints between the cord parts of the lamp sets and the power cords are not hidden inside the Christmas tree, prone to spoil the appearance of the Christmas tree and cause danger. And, because the lamps sets have to be fitted in position by means of connecting the plugs to the power cords one by one, it takes time to assemble the Christmas tree, and the Christmas tree isn't convenient or safe to use.

SUMMARY OF THE INVENTION

It is a main object of the present invention to provide an improvement on an assembled type Christmas tree to overcome the above disadvantages.

The Christmas tree of the present invention includes a trunk, and several lamp sets. The trunk includes several hollow rods, which are separably connected together by inserting lower ends into upper ends of adjacent rods, and each of which has a hole. Each hollow rod has a first and a second connecting members, which are respectively securely fitted in the upper and the lower ends of the rod. Each first connecting member has a fitting hole, and two terminals in the fitting hole thereof while each second connecting member has two terminals facing outwards. Each hollow rod has cords therein, which are connected to the terminals in two ends thereof. The lamp sets are passed through the holes of the hollow rods from cord parts thereof, which are connected to corresponding terminals in the rods. Thus, all of the lamp sets will be electrically connected to the cords in the hollow rods after the rods are connected together for the terminals in different hollow rods to be electrically connected; the joints between the cords of the lamp sets and the hollow rods are hidden inside the hollow rods, they can't show to spoil the appearance of the Christmas tree or cause danger.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
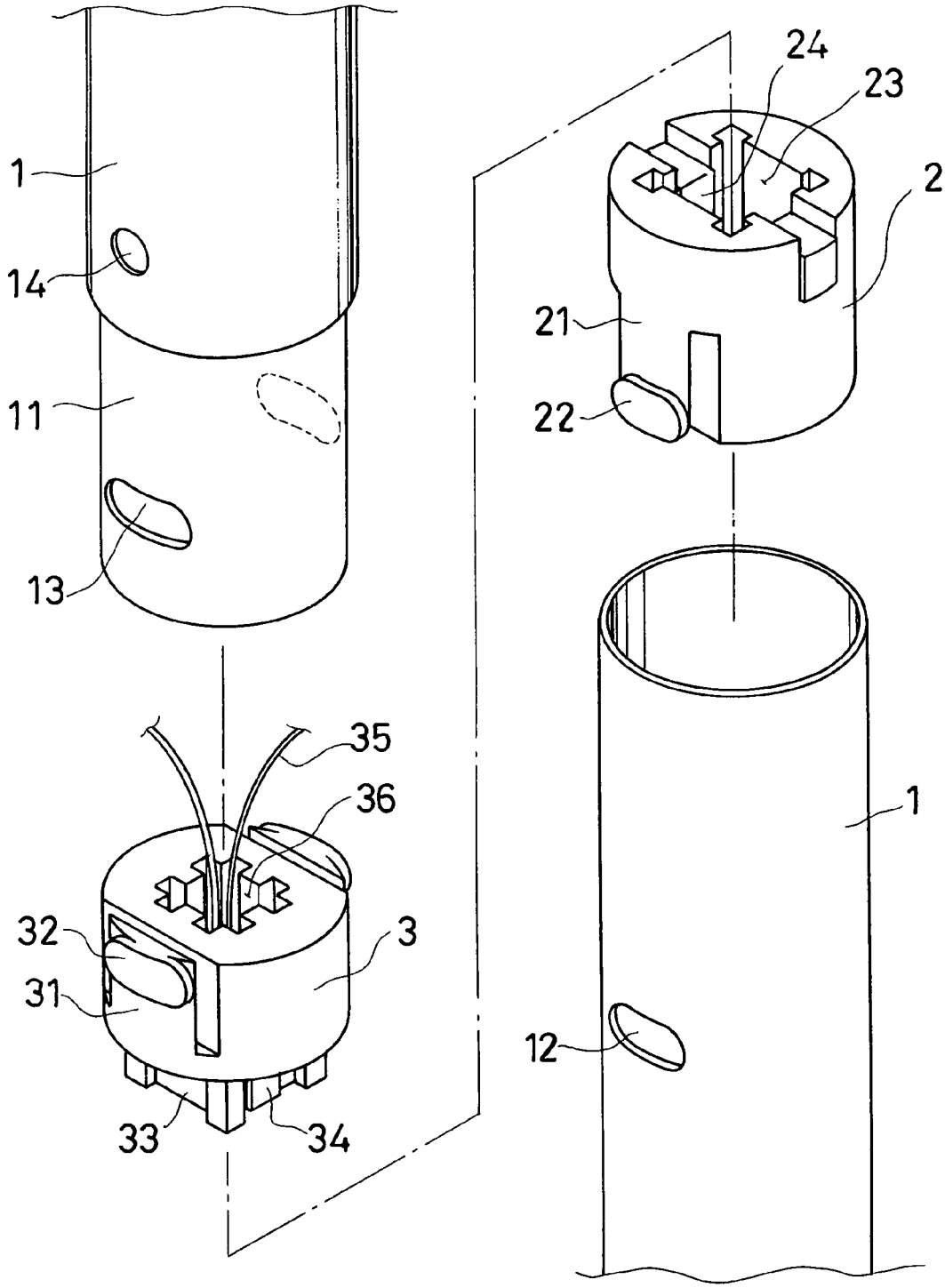
FIG. 1 is a partial exploded perspective view of the Christmas tree according to the present invention.
Figure 2:
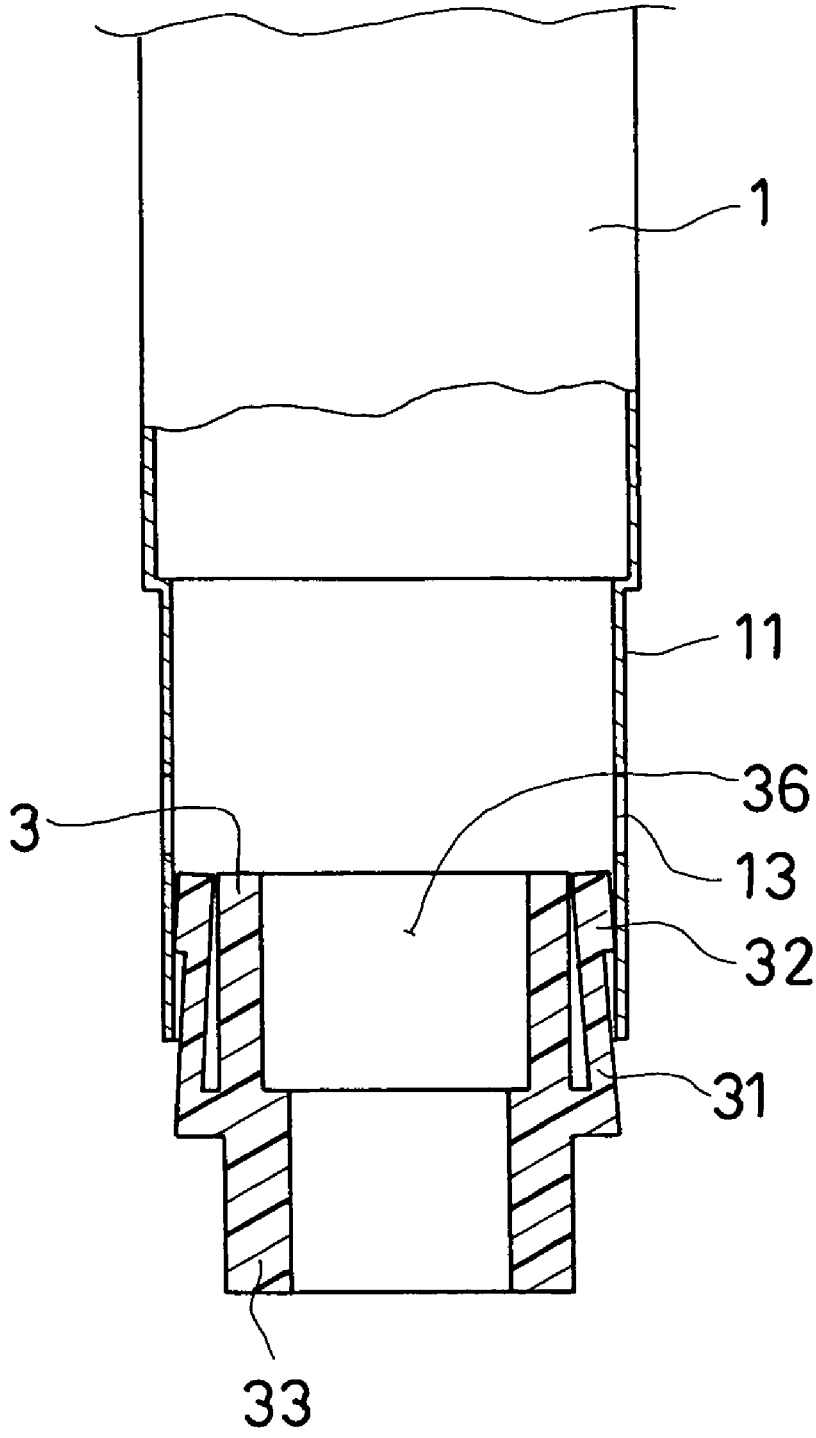
FIG. 2 is a partial cross-sectional view of a hollow connecting rod of the Christmas tree of the present invention.
Figure 6:
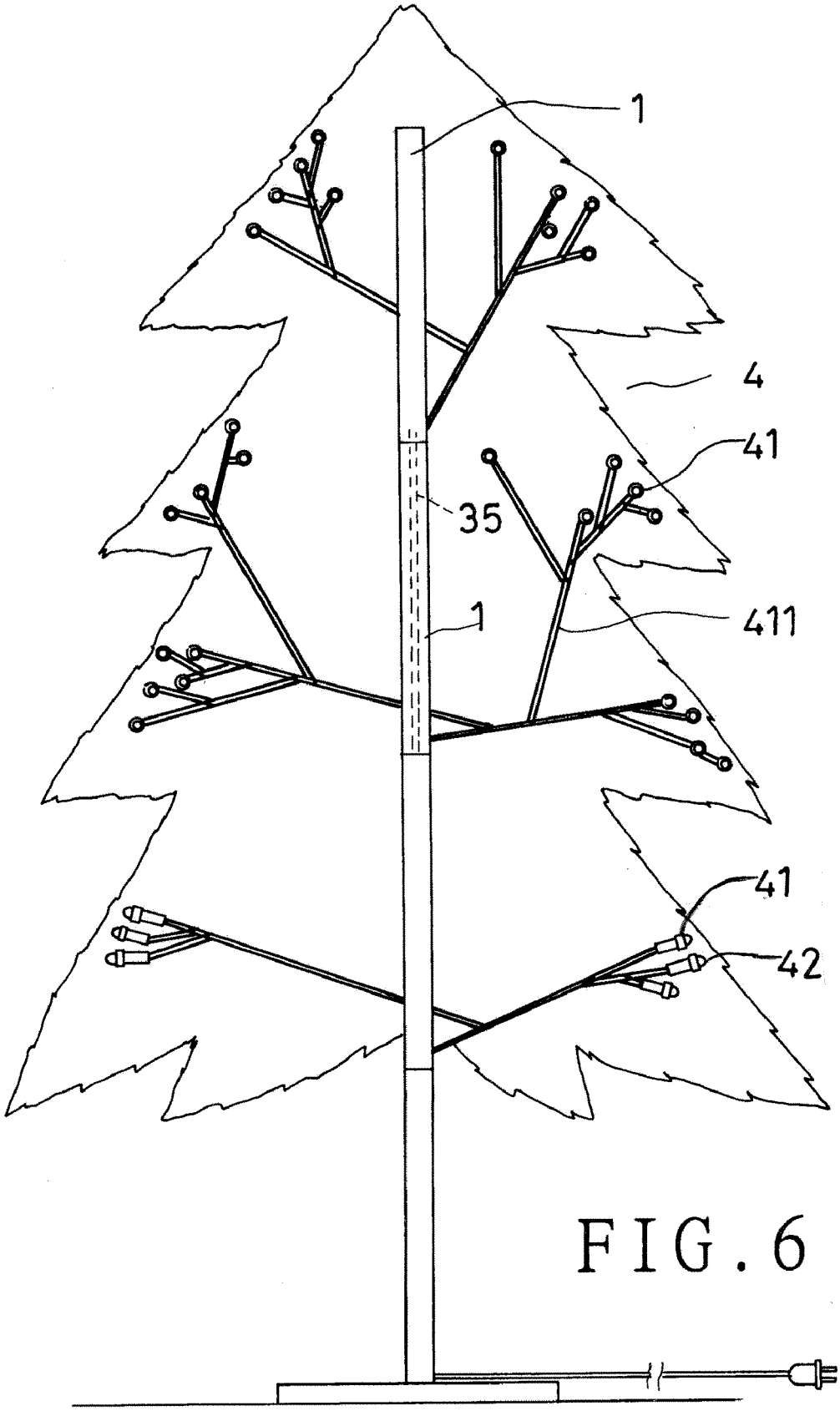
FIG. 6 is a schematic view of the Christmas tree of the present invention.

Referring to FIGS. 1 and 6, a preferred embodiment of an assembled type Christmas tree 4 in the present invention includes several hollow connecting rods 1, and several lamp sets 41.

Each of the hollow connecting rods 1 has an axial through hole, an insertion portion 11 at a lower end, two opposing locating holes 12 on an upper end, two opposing locating holes 13 on the insertion portion 11, and a through hole 14 thereon, which insertion portion 11 has a circumference substantially equal to an inner diameter of the upper end of the connecting rod 1. The hollow connecting rods 1 are separably connected together to form a trunk of the Christmas tree by means of inserting the insertion portions 11 into upper ends of adjacent hollow connecting rods 1.

Furthermore, each hollow connecting rod 1 has a first and a second connecting members 2 and 3 respectively securely fitted in the upper and the lower ends thereof; the first connecting member 2 has two flexible plates 21 facing opposite directions on the outer side, a locating protrusion 22 on each of the flexible plates 21, an axial fitting hole 23, and two opposing terminals 24 in the fitting hole 23, and the first connecting member 2 is fitted in the upper end of the hollow connecting rod 1 with the locating protrusions 22 passing through the corresponding locating holes 12; the second connecting member 3 has two flexible plates 31 facing opposing directions on the outer side, a locating protrusion 32 on each of the flexible plates 31, a fitting block portion 33 at a lower end, two terminals 34 facing opposite directions on an outer side of the fitting block portion 33, and an axial hole 36, and the second connecting member 3 is fitted in the insertion portion 11 of the hollow connecting rod 1 with the locating protrusions 32 passing through the corresponding locating holes 13.

Figure 3:
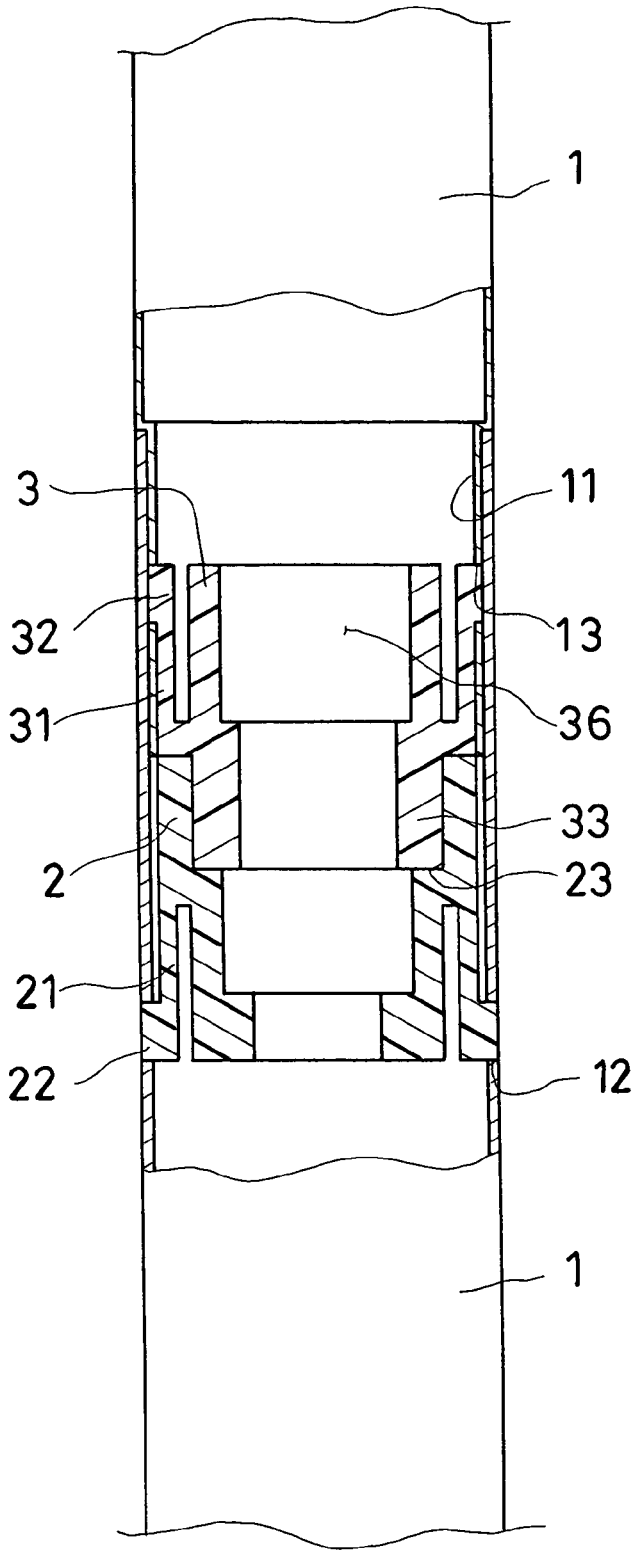
FIG. 3 is a partial cross-sectional view of the Christmas tree of the present invention.
Figure 4:
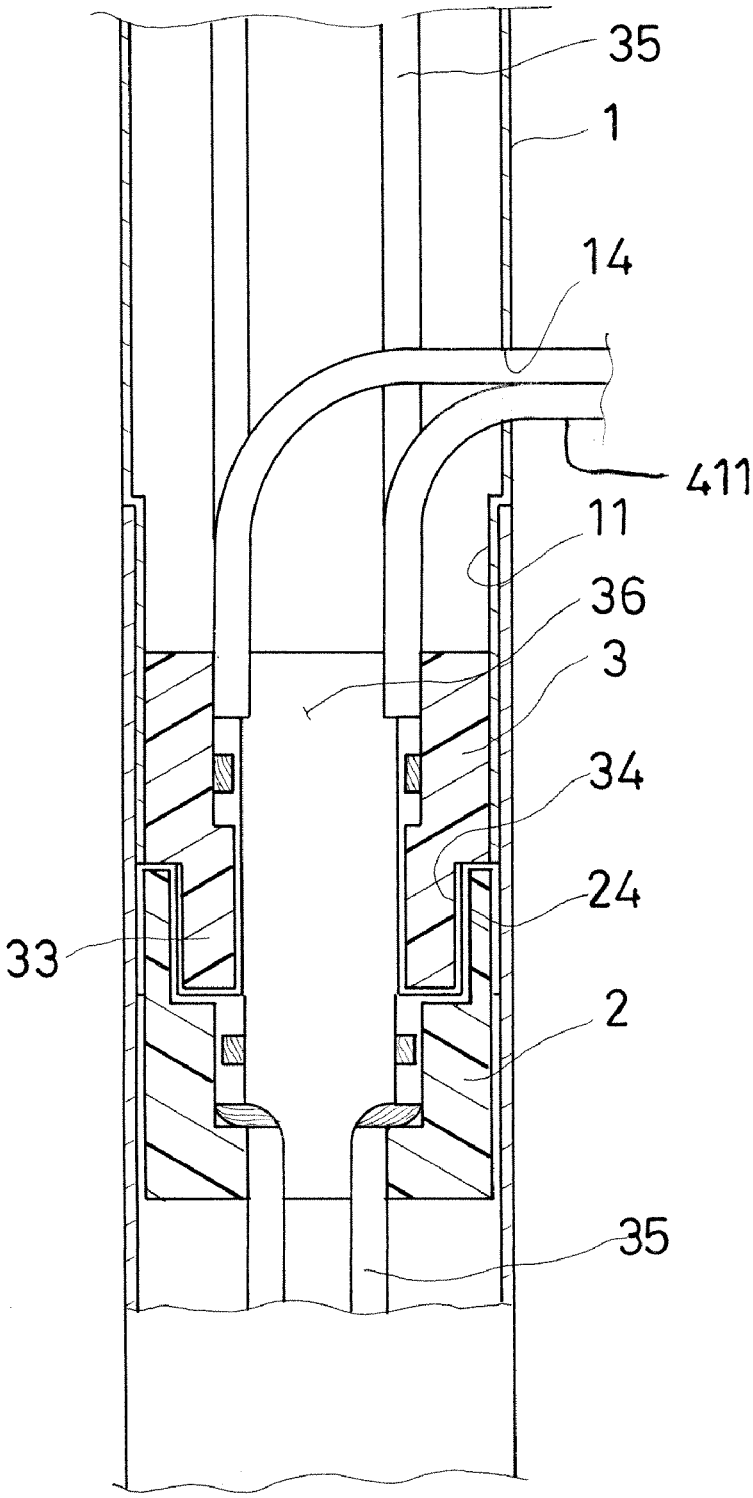
FIG. 4 is another partial cross-sectional view of the Christmas tree of the present inventions.
Figure 5:
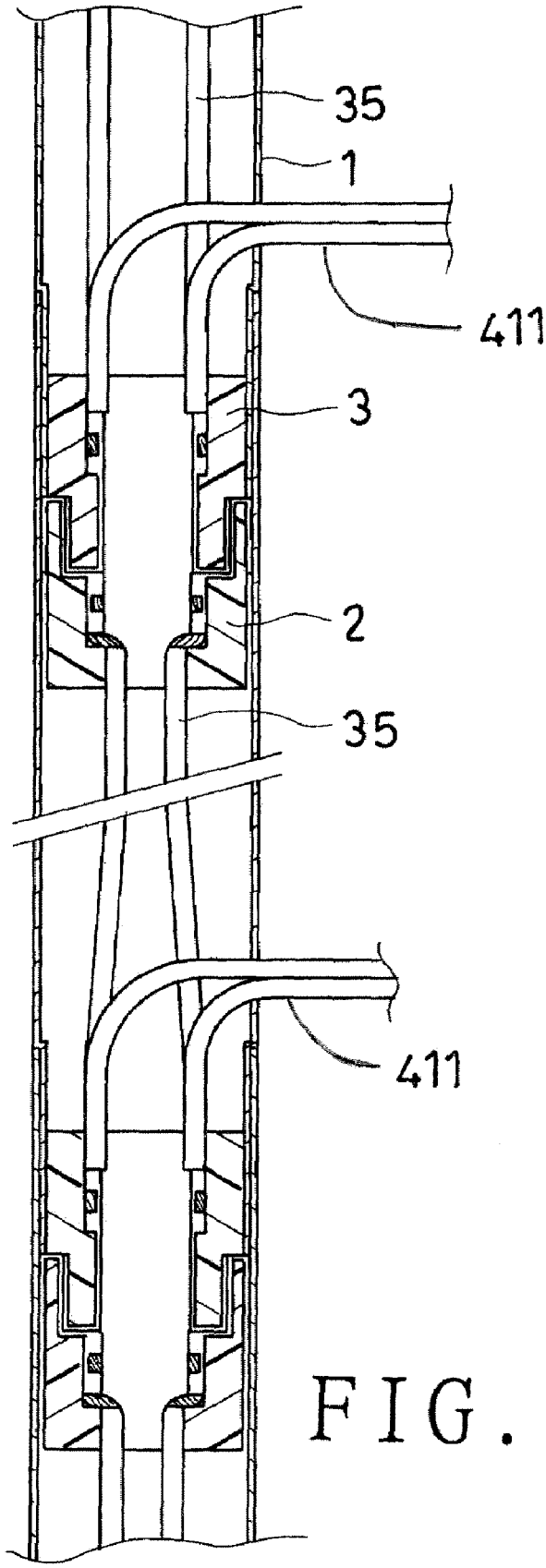
FIG. 5 is partial cross-sectional view of the Christmas tree of the present invention shown in FIG. 4, showing a larger section thereof.

Each hollow connecting rod 1 has cords 35 connecting the terminals 24 of the first connecting member 2 to the terminals 34 of the second connecting member 3 thereof. And referring to FIGS. 3, 4, and 5, the second connecting members 3 will be fitted in respective ones of the fitting holes 23 of the first connecting members 2 at the fitting block portions 33 thereof, and the terminals 24 will come into contact with respective ones of the terminals 34 when the hollow connecting rods 1 are connected together with the insertion portions 11 being inserted in upper ends of adjacent connecting rods 1, making the cords 35 of all of the hollow connecting rods 1 electrically connected.

Each of the lamp sets 41 includes two cords 411, and lamps 42 connected with the cords 411 thereof. The cords 411 of each lamp set are passed through the through hole 14 of a respective one of the hollow connecting rods 1, and connected to respective ones of the terminals 34; thus, all of the lamp sets can be powered after the hollow connecting rods 1 are connected together, and the Christmas tree 4 is plugged in.

To assemble the Christmas tree 4, first the first and the second connecting members 2 and 3 are securely fitted in the respective hollow connecting rods 1, and cords 35 are connected to the terminals 35 in each hollow connecting rod 1, and the lamp sets 41 are connected to respective ones of the hollow connecting rods 1, and electrically connected to the terminals 34. Next, the hollow connecting rods 1 are connected together; thus, the cords 35 and the lamp sets 41 are electrically connected.

The Christmas tree 4 is dismantled with the hollow connecting rods 1 being separated from each other when it isn't used; thus, the Christmas tree 4 will occupy less space in storage.

From the above description, it can be easily understood that the Christmas tree of the present invention is easier to assemble and more convenient to use than conventional ones. And, because the joints between the cords of the lamp sets and the hollow connecting rods are hidden inside the rods, they can't show to spoil the appearance of the Christmas tree or cause danger, and the Christmas tree is safe to use.

What is claimed is:

1. An assembled type Christmas tree, comprising a plurality of hollow connecting rods each having an axial through hole; each of the hollow connecting rods having an insertion portion at a lower end; each hollow connecting rod having two opposing locating holes on an upper end, and two opposing locating holes on the insertion portion; each hollow connecting rod having a through hole thereon;

the hollow connecting rods being separably connected together to form a trunk of the tree with the insertion portions being respectively inserted in upper ends of adjacent hollow connecting rods;

a plurality of first connecting members respectively securely fitted in the upper ends of the hollow connecting rods; each of the first connecting members having two flexible plates each formed with a first locating protrusion; the first locating protrusions passing through respective ones of the upper locating holes of the connecting rods; each first connecting member having an axial fitting hole, and two opposing terminals in the axial fitting hole;

a plurality of second connecting members respectively securely fitted in the insertion portions of the hollow connecting rods; each of the second connecting members having two flexible plates each formed with a second locating protrusion; the second locating protrusions passing through respective ones of the lower locating holes of the connecting rods; each second connecting member having a fitting block portion at a lower end, and two terminals facing opposite directions on an outer side of the fitting block portion thereof;

each hollow connecting rod having first cords therein, which connect the terminals of the first connecting member to the terminals of the second connecting member thereof; and a plurality of lamp sets; each of the lamp sets including second cords, and a plurality of lamps connected to the second cords thereof; the second cords of each lamp set being passed through a respective one of the through holes of the hollow connecting rods; the second cords being connected to respective ones of the terminals of the second connecting members;

the second connecting members being capable of being fitted in the axial fitting holes of corresponding first connecting members at the fitting block portions thereof with the terminals thereof touching the terminals of the corresponding first connecting members when the hollow connecting rods are connected together;

whereby all of the lamp sets will be electrically connected to the first cords in the hollow connecting rods after the hollow connecting rods are connected together.

* * * * *